United States Patent [19]

Kratzer

[11] 4,074,850

[45] Feb. 21, 1978

[54] X-RAY COMPUTER

[76] Inventor: Brice L. Kratzer, 4203 E. Jackson, Elkhart, Ind. 46514

[21] Appl. No.: 441,870

[22] Filed: Feb. 12, 1974

[51] Int. Cl.[2] ..... G06G 1/00

[52] U.S. Cl. ..... 235/89 R; 235/64.7

[58] Field of Search ..... 235/64.7, 70 R, 85, 235/88 R, 89 R

[56] References Cited

U.S. PATENT DOCUMENTS

| | | | |
|---|---|---|---|
| 1,186,093 | 6/1916 | Harvey | 235/85 R |
| 2,411,491 | 11/1946 | Williams | 235/64.7 |
| 2,443,882 | 6/1948 | Allen | 235/70 R |
| 2,455,522 | 12/1948 | Ringler | 235/70 R X |
| 2,484,366 | 10/1949 | Wilson | 235/88 |
| 2,639,091 | 5/1953 | Elias | 235/88 X |

*Primary Examiner*—Lawrence R. Franklin

*Attorney, Agent, or Firm*—Gust, Irish, Jeffers & Rickert

[57] ABSTRACT

A manually operable computer for determining exposure settings of an X-ray machine comprising two juxtaposed scale members. Means are provided for supporting said scale members for movement relative to each other, a first scale on one of said members denoting thicknesses of a subject to be radiographed and a second scale thereon in predetermined fixed relation to the first scale denoting certain exposure settings of an X-ray machine. A third scale is provided on the other scale member denoting certain other exposure settings, said second and third scales together forming a single chart of exposure settings in the form of voltage, current and time. The first scale includes a plurality of non-linearly spaced dimensional indicia indicative of said thicknesses. The second scale includes a plurality of spaced indicia of one form of exposure setting, and the third scale includes a plurality of spaced indicia of a second form of exposure setting in generally parallel juxtaposed arrangement with respect to the indicia of the second scale. The indicia of the second and third scales when positionally related determines the settings of an X-ray machine to obtain a particular X-ray exposure. The spacings, values and positional relationship of the aforesaid indicia are further arranged and selected according to predetermined non-linear relationships as to provide X-ray exposure settings on the chart for different thicknesses of a given anatomical subject which will yield a substantially constant density radiograph, all other conditions of taking the radiograph remaining constant. Indexing means identifiable with selected ones of said dimensional indicia for determining the relative positions of said first and second members are provided on said supporting means.

9 Claims, 14 Drawing Figures

FIG.8

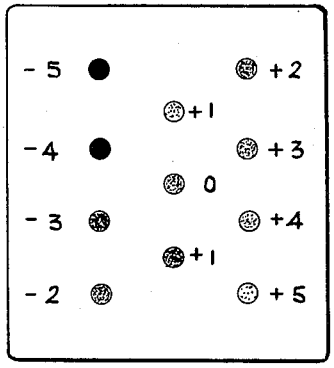

MASTER FILM

FIG.7

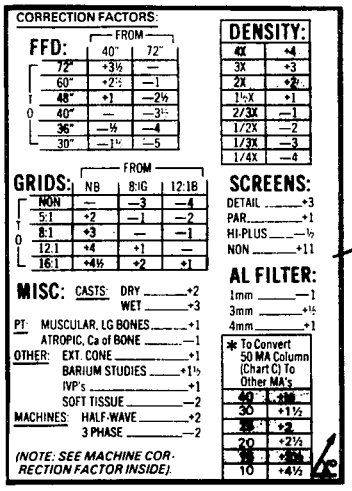

CORRECTION FACTORS:

FFD:

| TO | FROM 40" | FROM 72" |
|---|---|---|
| 72" | +3½ | — |
| 60" | +2½ | —1 |
| 48" | +1 | —2½ |
| 40" | — | —3½ |
| 36" | —½ | —4 |
| 30" | —1½ | —5 |

GRIDS:

| TO | FROM NB | FROM 8:1G | FROM 12:1B |
|---|---|---|---|
| NON | — | —3 | —4 |
| 5:1 | +2 | —1 | —2 |
| 8:1 | +3 | — | —1 |
| 12:1 | +4 | +1 | — |
| 16:1 | +4½ | +2 | +1 |

MISC: CASTS: DRY +2; WET +3

PT: MUSCULAR, LG BONES +1; ATROPIC, Ca of BONE —1

OTHER: EXT. CONE +1; BARIUM STUDIES +1½; IVP's +1; SOFT TISSUE —2

MACHINES: HALF-WAVE +2; 3 PHASE —2

(NOTE: SEE MACHINE CORRECTION FACTOR INSIDE).

DENSITY:

| | |
|---|---|
| 4X | +4 |
| 3X | +3 |
| 2X | +2 |
| 1½X | +1 |
| 2/3X | —1 |
| 1/2X | —2 |
| 1/3X | —3 |
| 1/4X | —4 |

SCREENS:

DETAIL +3; PAR +1; HI-PLUS —½; NON +11

AL FILTER:

1mm —1; 3mm +½; 4mm +1

* To Convert 50 MA Column (Chart C) To Other MA's

| | |
|---|---|
| 40 | [illegible] |
| 30 | +1½ |
| [illegible] | +2 |
| 20 | +2½ |
| [illegible] | [illegible] |
| 10 | +4½ |

200

FIG.6

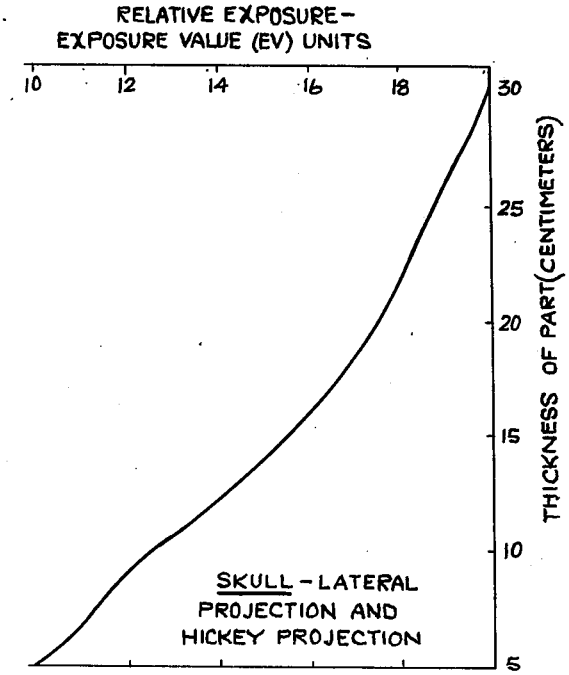

FIG. 13

208

210

218

216

MA

| KV | 50 | 100 | 200 | 300 | 500 | 700 | 1000 | MAS |
|---|---|---|---|---|---|---|---|---|
| MORE CONTRAST | 24 | 12 | 6 | 4 | 2 1/2 | 2 | 1 1/4 | 1200 |
| | 20 | 10 | 5 | ↑ | 2 | 1 1/2 | 1 | 1000 |
| | 16 | 8 | 4 | 3 | ↑ | 1 1/4 | .8 4/5 | 800 |
| | 14 | 7 | ↑ | 2 1/2 | 1 1/2 | 1 | .7 3/4 | 700 |
| | 12 | 6 | 3 | 2 | 1 1/4 | .8 4/5 | .6 3/5 | 600 |
| 40 | 10 | 5 | 2 1/2 | ↑ | 1 | .7 3/4 | .5 1/2 | 500 |
| 42 | 8 | 4 | 2 | 1 1/2 | .8 4/5 | .6 3/5 | .4 2/5 | 400 |
| 44 | 7 | ↑ | ↑ | 1 1/4 | .7 3/4 | .5 1/2 | .35 ↑ | 350 |
| 46 | 6 | 3 | 1 1/2 | 1 | .6 3/5 | .4 2/5 | .3 3/10 | 300 |
| 48 | 5 | 2 1/2 | 1 1/4 | .8 4/5 | .5 1/2 | .35 ↑ | .25 1/4 | 250 |
| 50 | 4 | 2 | 1 | .7 3/4 | .4 2/5 | .3 3/10 | .2 1/5 | 200 |
| 52 | ↑ | ↑ | .8 4/5 | .6 3/5 | .35 ↑ | .25 1/4 | .18 ↑ | 170 |
| 55 | 3 | 1 1/2 | .7 3/4 | .5 1/2 | .3 3/10 | .2 1/5 | .15 3/20 | 150 |
| 58 | 2 1/2 | 1 1/4 | .6 3/5 | .4 2/5 | .25 1/4 | .18 ↑ | .12 1/8 | 120 |
| 60 | 2 | 1 | .5 1/2 | .35 ↑ | .2 1/5 | .15 3/20 | .10 1/10 | 100 |
| 63 | ↑ | .8 4/5 | .4 2/5 | .3 3/10 | .18 ↑ | .12 1/8 | .08 1/12 | 80 |
| 66 | 1 1/2 | .7 3/4 | .35 ↑ | .25 1/4 | .15 3/20 | .10 1/10 | .07 1/15 | 75 |
| 70 | 1 1/4 | .6 3/5 | .3 3/10 | .20 1/5 | .12 1/8 | .08 1/12 | .06 ↑ | 60 |
| 73 | 1 | .5 1/2 | .25 1/4 | .18 ↑ | .10 1/10 | .07 1/15 | .05 1/20 | 50 |
| 76 | .8 4/5 | .4 2/5 | .2 1/5 | .15 3/20 | .08 1/12 | .06 ↑ | .04 1/24 | 40 |
| 80 | .7 3/4 | .35 ↑ | .18 ↑ | .12 1/8 | .07 1/15 | .05 1/20 | .035 1/30 | 35 |
| 83 | .6 3/5 | .3 3/10 | .15 3/20 | .10 1/10 | .06 ↑ | .04 1/24 | .03 ↑ | 30 |
| 86 | .5 1/2 | .25 1/4 | .12 1/8 | .08 1/12 | .05 1/20 | .035 1/30 | .025 1/40 | 25 |
| 90 | .4 2/5 | .2 1/5 | .10 1/10 | .07 1/15 | .04 1/24 | .03 ↑ | .02 ↑ | 20 |
| 96 | .35 ↑ | .18 ↑ | .08 1/12 | .06 ↑ | .035 1/30 | .025 1/40 | .018 1/60 | 17.5 |
| 100 | .3 3/10 | .15 3/20 | .07 ↑ | .05 1/20 | .03 ↑ | .02 ↑ | .015 ↑ | 15 |
| 104 | .25 1/4 | .12 1/8 | .06 1/15 | .04 1/24 | .025 1/40 | .018 | .012 | 12.5 |
| 108 | ↑ | ↑ | ↑ | ↑ | ↑ | 1/60 | | |
| 112 | .2 1/5 | .10 1/10 | .05 1/20 | .035 1/30 | .02 | ↑ | .01 | 10 |
| 120 | .18 ↑ | .08 1/12 | .04 1/24 | .03 ↑ | .018 1/60 | .015 | .008 1/120 | |
| 124 | .15 3/20 | .07 1/15 | .035 1/30 | .025 1/40 | .015 ↑ | .01 | .007 ↑ | 7 |
| 129 | .12 1/8 | .06 ↑ | .03 ↑ | .02 ↑ | .012 | .008 1/120 | | 6.25 |
| 137 | .10 1/10 | .05 1/20 | .025 1/40 | .018 1/60 | .01 | .007 ↑ | .006 | 5 |
| 144 | .08 1/12 | .04 1/24 | .02 ↑ | .015 ↑ | .008 1/120 | .006 | .004 1/240 | |
| 150 | .07 1/15 | .035 1/30 | .018 1/60 | .012 | .007 ↑ | .005 | ↑ | 3.3 |
| | .06 ↑ | .03 ↑ | .015 ↑ | .01 | .006 | .004 1/240 | .003 1/360 | |
| | .05 1/20 | .025 1/40 | .012 | .008 1/120 | .005 | ↑ | ↑ | 2.5 |
| | .04 1/24 | .02 ↑ | .01 | .007 ↑ | .004 1/240 | .003 1/360 | .002 | |
| LESS CONTRAST | .035 1/30 | .018 1/60 | .008 1/120 | .006 | .003 ↑ | ↑ | | 1.7 |

X-RAY COMPUTER

BACKGROUND OF THE INVENTION

1. Field of the Invention

The invention relates generally to the determination of proper X-ray exposures in connection with producing radiographs and more particularly to a computer usable by technicians for determining the proper X-ray exposure settings of an X-ray machine with facility and accuracy.

2. Description of the Prior Art

Problems related to technique selection of X-ray exposures in connection with the production of a quality radiograph are well known and include obtaining quality radiographs regardless of the patients size or age, obtaining consistent radiographs regardless of the machine being used or the technologist using the machine, the difficulty of using correction factors, especially when several are used at once, and the inability to use any kilovoltage, milliamperage, or time the situation or radiologist may require.

Generally it is desired to produce substantially the same density radiograph for exposures of different anatomical parts and parts of different thicknesses. Different anatomical parts have different thicknesses and thus require different exposures for obtaining the same radiograph density. The prior art teaches there is one thickness-to-exposure relationship for the entire body which is linear for obtaining the same radiograph density, but this axiom has been found to be erroneous in connection with the achievement of the present invention.

Manually operable computers, or more specifically slide rules, are known and used to some extent in connection with the determination of the exposure settings of an X-ray machine for a given tissue thickness or anatomical part. However, such slide rules have been found to be not only cumbersome and inaccurate but not applicable to all X-ray machines.

SUMMARY OF THE INVENTION

In accordance with the broader aspects of this invention, there is provided a manually operable computer for determining exposure settings of an X-ray machine comprising a plurality of elongated juxtaposed scale members. Means are provided for supporting the scale members for longitudinal movement relative to each other, said members each having opposite commonly facing sides. One of the members has on one side a scale denoting thicknesses of a subject to be radiographed and on the opposite side one part of a two part exposure chart. The other member has a total correction factor scale on the side facing the same as said thickness scale and on the opposite side the second part of said exposure chart. The thickness scale includes a plurality of dimensional indicia spaced apart longitudinally of said one member in generally ascending values. The spacing of said indicia of said thickness scale is non-linear in relation to the values thereof. The total correction factor scale includes longitudinally spaced indicia representative of different exposure correction factors. Index means are provided for aligning transversely selected indicia of said thickness and total correction factor scales. The exposure chart contains scalar information for determining the voltage, current and time settings of an X-ray machine required for providing a given X-ray exposure. Said one part of said exposure chart contains at least one scale of spaced time indicia arranged longitudinally of said one member in ascending order. The scale of time indicia includes indicia representative of a predetermined value of current. The second part of the exposure chart contains a scale of spaced voltage indicia with values arranged in ascending order longitudinally of the second member with the direction of ascendency being opposite to that of said time indicia. The transverse juxtaposition of time and voltage indicia combined with the value of said current indicia determines the exposure setting of an X-ray machine. The spacing, values, and positions of said dimensional, voltage, time and current indicia for a given total correction factor indicia are such as to provide values of X-ray exposure which yield substantially uniform density in a radiograph for different thicknesses of a like anatomical subject when said dimensional indicia is selectively aligned transversely with said index means and correction factor indicia. The thickness scale is graduated according to a predetermined non-linear relationship between tissue thickness and X-ray exposure.

It is an object to provide a computer and a method for determining X-rav exposures resulting in substantially uniform radiograph densities based on predetermined non-linear relationships between tissue thickness and exposure.

It is another object of this invention to provide a device and method by which a technician may determine with facility from such data as he is given regarding tissue thickness or thickness of an anatomical part the settings of voltage, current and time for making a proper X-ray exposure.

It is still another object of this invention to provide a device which functions as a slide rule, by which the determination of voltage, time and current for proper exposure by X-ray equipment will be facilitated from certain known or predetermined non-linear relationships between tissue thickness and X-ray exposure.

It is another object to provide a slide rule device for determining proper exposure by an X-ray machine in the form of multiple combinations of voltage, current and time data that produce the same exposure.

It is another object to provide a method for calibrating an X-ray machine for use with the aforesaid slide rules.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 6 is a typical curve for use in explaining the non-linear relationships between tissue thickness and X-ray exposure;

FIG. 7 is a typical, predetermined chart of correction factors which provide input information for the computer of the preceding figures;

FIG. 8 is a plan view of a master film used in calibrating an X-ray machine for use with the computer of this invention;

FIG. 13 is an enlargement of FIG. 5.

DESCRIPTION OF THE PREFERRED EMBODIMENT

Figure 1:
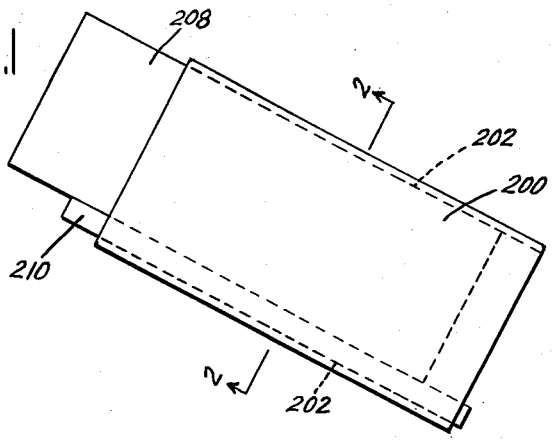
FIG. 1 is a perspective illustration of a typical computer of this invention.
Figure 2:
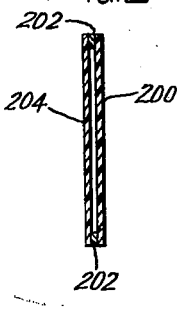
FIG. 2 is a cross section taken substantially along section line 2—2 of FIG. 1 but with the two sliding scales removed.
Figure 9:
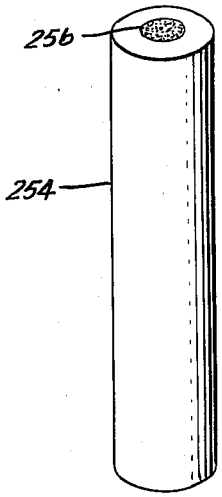
FIG. 9 is a standard object used in the calibration of an X-ray machine.
Figure 10:
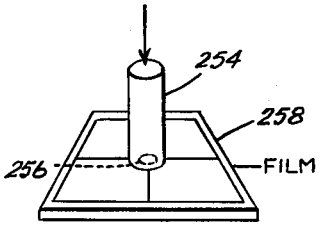
FIG. 10 is a diagrammatic illustration of the device of FIG. 9 used in connection with exposing radiograph films.
Figure 3:
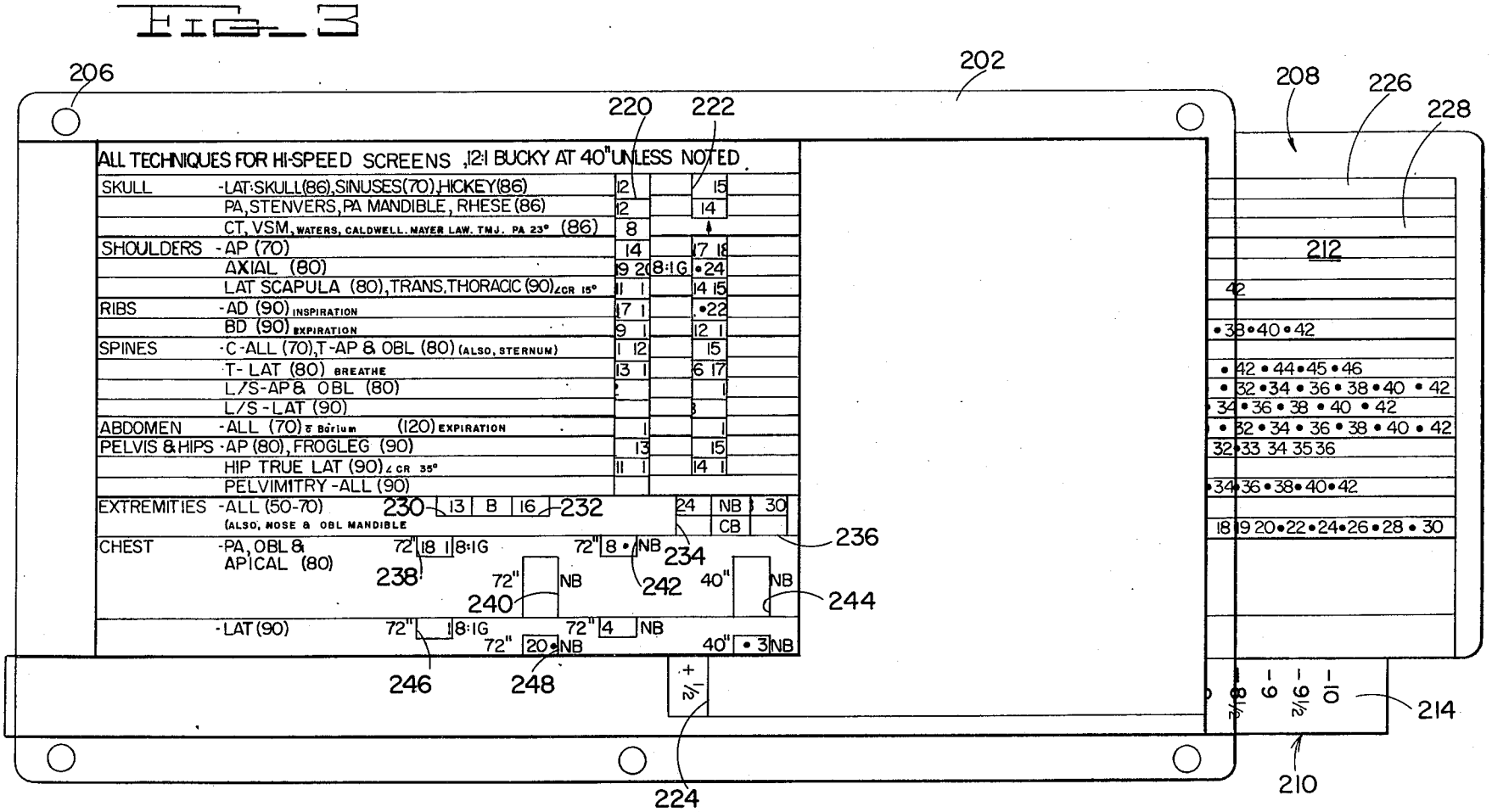
FIG. 3 is a view substantially to scale of one side of the computer of FIG. 2.

Referring to the drawing and more particularly to FIGS. 1, 2 and 3, the computer there shown is in the form of a slide rule fabricated of parts which for the most part are of a suitable plastic. The slide rule includes a flat base member 200 of plastic, rectangular in shape, and having secured at the longitudinal edges two elongated spacing strips 202 and a transparent member 204 of plastic fixedly superposed thereon congruent with respect to base member 200. Suitable rivets 206 are used for the purpose of securing the parts 200, 202 and 204 together.

The members 200 and 204 are parallel and spaced apart just sufficiently to receive frictionally two flat plastic sliding scale members 208 and 210, these scale members being rectangular and disposed in edge-to-edge relationship thereby providing a total width which frictionally fits between the two spacer strips 202. The scale members 208 and 210 may be frictionally moved relative to each other and also to the frame composed of the two members 200 and 204.

Both scale members 208 and 210 have commonly facing surfaces (FIG. 3) 212 and 214 on one side and on the opposite side commonly facing surfaces 216 and 218, respectively. These surfaces carry scales which will be explained in detail hereinafter. The base member 200 is preferably opaque and is provided with indexing means or windows or openings 220 and 222 which are spaced apart and parallel and which extend transversely of at least part of the base member 200. There are other windows or openings on this base member which will be identified and explained later on.

The surfaces 212 and 214 of the scale members 208 and 210 are provided with scales which in part are visible through the windows in the member 200, the scale on the surface 214 being visible through a window 224 in the base member 200. There are no windows on the opposite side of the slide rule, the surfaces 216 and 218 of two scale members being fully exposed through the transparent cover 204.

Figures 4A, 4B, 5:
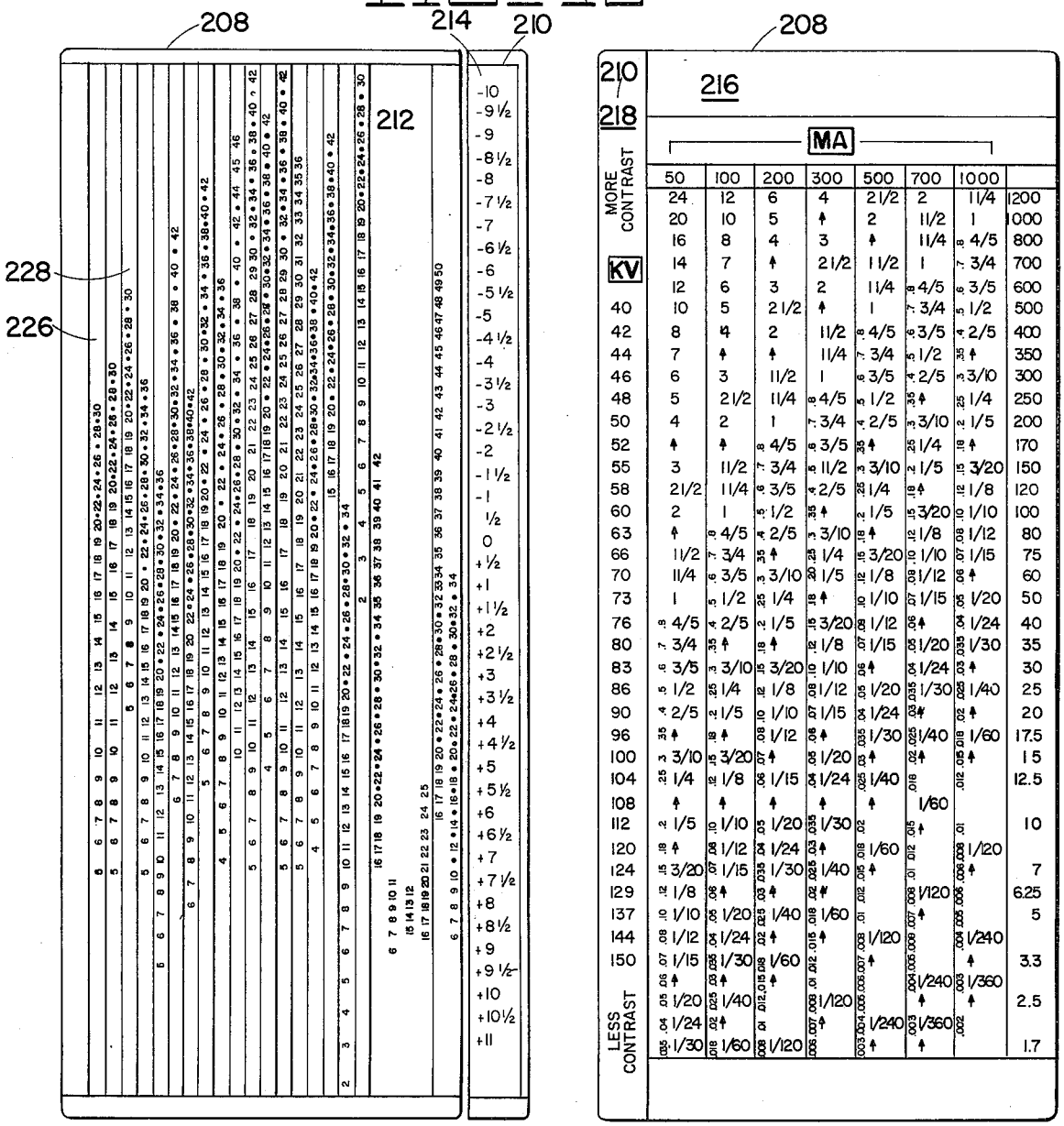
FIGS. 4*a* and 4*b* are plan views substantially to scale of the two sliding scale members contained in the combination of FIGS. 1 and 3.
FIG. 5 is a view similar to FIGS. 4*a* and 4*b* showing the opposite sides of the two movable scale members, the views of FIGS. 4*a*, 4*b* and FIG. 5 being to scale, directly related and in transverse alignment.
Figure 12:
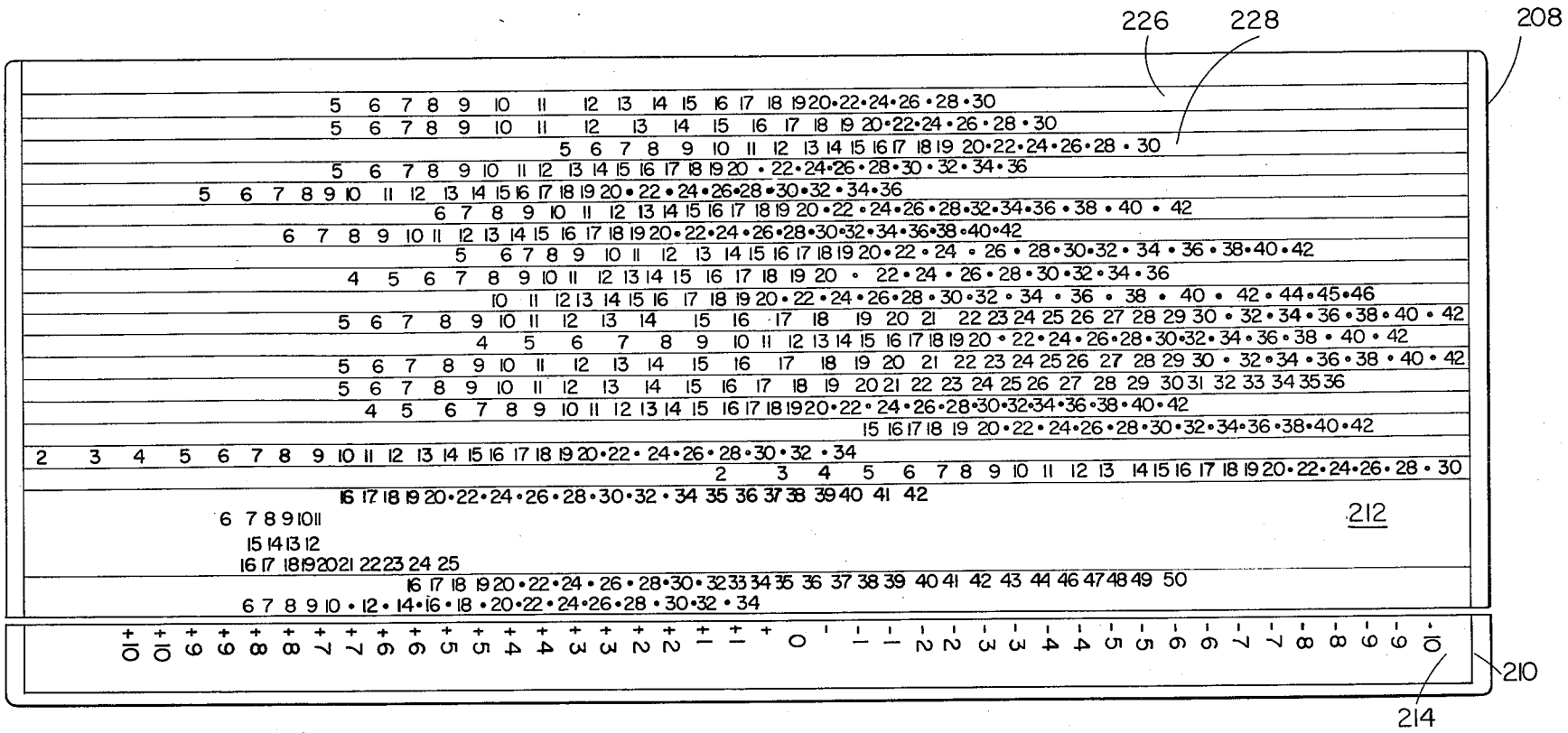
FIG. 12 is an enlargement of FIGS. 4*a* and 4*b*.

In one embodiment of this invention, the surface 212 has twenty-two discrete, positionally related scales thereon, the rows of numbers of FIG. 4*a* representing these scales, respectively, there being twenty-two such rows. The numbers of each row relate to a particular anatomical part or parts such that the twenty-two rows or scales relate to as many or more anatomical parts. The numbers in each scale represent tissue thickness or the thickness of the part being X-rayed while the spacing between the numbers is predetermined and is non-linear as relates to the values of thickness indicia. One such scale is indicated by the numeral 226 and contains dimensional indicia ranging from five to thirty centimeters. Another scale is indicated by the numeral 228 and also contains thickness data ranging from five to thirty centimeters. As will be noted from viewing FIG. 4*a*, other scales have different ranges of dimensional data, but in particular it will be noted that all of the scales have different position and spacing relationships between the dimensional indicia thereof.

The scale member 210 has on the surface 214 a longitudinally graduated scale of total-correction factors. These factors are numbers ranging to the plus and minus sides of zero linearly spaced as shown. For purposes of convenience, one-half graduations are provided between the whole numbers.

The spacing and number values of these correction factors on the surface 214, this surface hereinafter also at times being referred to as the scale 214, are precisely related to the values and spacings of the dimensional indicia on the surface 212 as well as the information contained on the opposite surfaces 216 and 218 of the scale members. The relationship between these numbers and positions as shown to scale in FIGS. 4*a*, 4*b* and 5 will be explained more fully hereinafter. In other words, if a slide rule is constructed using these drawings as the masters, an instrument should be obtained that will provide reasonable accuracy in performing calculations.

Continuing, the surfaces 216 and 218 conjointly carry an exposure chart of X-ray settings in terms of kilovoltage, milliamperage and exposure times. Also an additional column of information is contained thereon headed by the term "MAS" which is a conventional term in radiologic technology referring to values of the product of milliamperage and time increments. Some X-ray machines are calibrated in terms of "MAS" values.

More specifically, the surface 218 of the scale member 210 carries a column of numbers evenly spaced apart having the values as shown. These numbers represent kilovoltage settings of an X-ray machine. The part of the chart on the surface 216 is divided into seven columns of information relating to exposure time, each column being headed by a different value of milliamperage as shown. The final or eighth column contains "MAS" values which are the products of the currents and time numbers in the transversely aligned rows. The numbers and values on chart 216, 218 are precisely located and related, and preferably are evenly spaced apart as shown. The chart shown in FIG. 5 is of an operable embodiment of this invention, with the numbers and positions thereon being precisely related to the numbers and positions on the charts 212 and 214 on the opposite side of the scale members 208 and 210. The alignment between FIGS. 4*a*, 4*b* and 5 positionally relate the numbers on these scale members.

Charts 216, 218 provides upwards of two-hundred combinations of kilovoltage, milliamperage, and time from which the factors best suited to a particular patient and situation may be selected. Chart 218 labeled "KV", the seven center columns labeled "50 through 1,000 MA", and the right-hand column labeled "MAS" constitute the exposure chart. All of the numbers in the milliamperage columns are time in seconds or fraction of seconds. Any combination of kilovoltage, milliamperage, and time appearing on the chart can be selected as the technique; however, two cautions are involved, the X-ray machine should not be overloaded and in every instance a high enough kilovoltage should be used to penetrate the part.

Some of the many possible exposure combinations with the members 208 and 210 positioned as shown in FIG. 5 would be as follows:

| KV | MA | Time |
|---|---|---|
| 80 | 500 | 1/30 |
| 66 | 50 | 1 |
| 112 | 300 | 1/40 |
| 144 | 1,000 | 1/360 |

All combinations appearing on chart 216, 218 give the same density on the film. By choosing different combinations, one has the ability to regulate the contrast, motion, etc. in making an exposure. Thus, kilovoltage can be chosen first to give the desired contrast, and the milliamperage and time combinations selected from the matching line, or the milliamperage and time can be chosen first, and the computer will give the corresponding kilovoltage.

If the desired time falls between two kilovoltage values, the kilovoltage midway between those values would be used. For instance, if the desired time matches between 76 and 80 KV then 78 KV would be used. This relationship between kilovoltage and MAS holds true for any relative position on the scale member 210 with respect to the scale member 208.

Referring now to FIGS. 3 and 4*a*, it will be noted that scale member 208 is slidably received between the base member 200 and the transparent cover 204. The exposed surface of the base member 200 carries legending as shown denoting different anatomical parts and radiographic projections. This legending is divided in longitudinally extending parallel rows which are in precise, overlying registry with the scales on the surface 212 of the member 208. For example, the legend "skull" and the printed information following to the right-hand side thereof overlies in precise registry the scale 226. Similarly, the legending beginning with the letters "CT, VSM, Waters", etc. overlies the scale 228. The windows 220 and 222 are spaced apart and parallel in the position shown on the member 200, and are just wide enough to expose one of the numbers in a selected scale 226, 228, etc. The length of these windows 220, 222 are just sufficient to overlie 16 and 15, respectively, of the scales on surface 212, however it should be noted that window 222 is opaque over the third scale 228. For the scale identified by the word "EXTREMITIES", four windows 230, 232, 234 and 236 are provided sized and positioned as shown in relation to the other scales and other parts described and shown. For the scale labeled "CHEST", additional windows 238, 240, 242 and 244 are provided sized, spaced and shaped in relation to the other parts of the slide rule as shown in the drawing.

Lastly, the bottom scale carries four additional windows 246, 248, 250 and 252 sized and positioned as shown. For the scale 214, a single window 224 is provided in base member 200 which exposes single ones of the correction-factor indicia shown on the scale of FIG. 4*b*.

This slide rule is so designed as to provide technique for adults aged twelve and over and for children under age twelve. This is accomplished by the particular positioning of the window and scale value, such that in use, all adult indicia of the various scales are read through the windows 220, 230, 234, 238, 242, 246 and 250. The children's indicia are read through the windows 222, 232, 236, 240, 244, 248, and 252. In practice, the windows for the adult readings are outlined with black lines while those for the children are outlined in red. The technician may easily distinguish, then, between the adult and children's portions of the computer.

The windows described are precisely related to the various indicia on the scale members as shown in the drawings.

Referring to FIG. 6, the non-linear configuration of the various scales 226, 228, etc. on surface 212 will be explained. In the prior art it is taught that the relationship between tissue thickness (centimeters) and exposure is linear for the entire body. However, this axiom is erroneous. In order to determine the correct thickness-to-exposure relationships, actual information regarding a large number of clinical radiographs was collected on data cards, which information included the exposure used, and the technical quality of the radiograph. Graphs were made from the information contained on these cards which represented the best radiographs. One graph was made for each part of the body for both adults and children similar to the one shown in FIG. 6. The graph of FIG. 6 is representative of the scale 226, on the surface 212 and is one of the non-linear relationships. Each graph made from the data cards was translated into the scales on the two members 208, 210.

In connection with the design of the exposure charts 216, 218, exposure combinations that produced the same density on the film were experimentally determined. This was accomplished by means of a standard subject and a densitometer. This information was then combined to form the charts 216, 218. Thus, in any given position of the two scale members 208 and 210, all of the exposure combinations shown will give the same density on the film.

Referring to FIG. 7, a chart is there shown of correction factors for the slide rule of this invention using various grids, screens, filters, focal-film distances and such miscellaneous items as are there noted. Use of these correction factors is included in the explanation of the slide rule that follows later.

Operation of the slide rule will now be explained. The chart on base member 200 shown in FIG. 3 determines exposure based on the patient's size and age. In order to use it, the thickness of the part to be radiographed is first measured through the path of the central ray. Next, the line of the chart that contains the required part and view is located. Finally, the number of centimeters measured is entered in the appropriate opening on that line by moving the base member 200 which may be referred to as the large slider 200. If the patient is an adult (12 years or over) the measurement is entered in the opening or window 220. If the patient is a child, the window or opening 222 is used.

For instance, if the shoulder of a twenty-one year old was to be radiographed in an anteroposterior projection and the measurement through the central ray was fourteen centimeters, then fourteen would be entered in window 220 on the line of the chart of FIG. 3 labeled "SHOULDER-AP".

The computer provides techniques for use with high-speed screens, 12:1 bucky grids at 40 inches unless otherwise noted on the chart of FIG. 7. To correct these techniques to any other combination of grids, screens, distance, filtration, etc. the chart of FIG. 7 is used. The chart of FIG. 7 can also be used to correct for a miscalibrated X-ray machine.

The needed correction factor is selected from the chart of FIG. 7 in accordance with the following example:

| | |
|---|---|
| Wet Cast | +3 |
| High-plus Screen | $-\frac{1}{2}$ |
| From 40 to 48" | +1 |
| From 12 to 1 bucky to non-bucky (NB) | −4. |

If an oblique gallbladder were to be radiographed using an extension cone and a 30-inch focal-film distance (FFD), two correction factors from the chart of FIG. 7 would be utilized: an extension cone is +1 and from forty to thirty inches is $-1\frac{1}{2}$. The total of the two correction factors is $-\frac{1}{2}$ which would then be entered in window 224.

Since the calibration of X-ray machines varies, the film densities produced by one machine could be darker than normal, and the film densities produced by another machine could be lighter than normal, when identical exposure factors are used. To correct for this miscalibration a machine correction factor can be used. To determine the correction factor for a particular X-ray machine, a standard subject of a given size and composition is exposed at specific exposure factors, and the density of resultant image is evaluated. The evaluation may be made by means of a densitometer or also may be made by means of a master film that is composed of dots of varying densities that have been experimentally produced to match specific errors in machine calibration.

Referring to FIGS. 8 through 11, a standard object is in the form of a cylinder 254 of acrylic plastic having a lead disc 256 coaxially mounted in one end of the cylinder 254. This cylinder is exposed on a high-speed cassette 258 with the lead disc adjacent to the film using 30-milliampere-seconds and 50-kilovolts with a 40-inch focal-film distance. The cone field is adjusted to approximately 3-inches across. If high-speed screens are not available, par-speed screens may be used, and 1 is subtracted from the correction factor which is derived.

Figure 11:
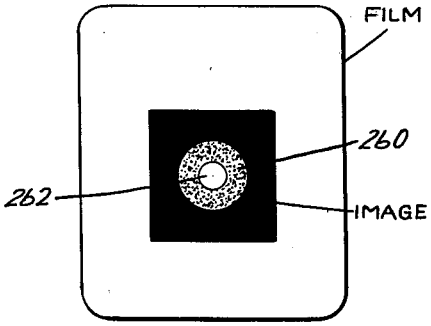
FIG. 11 is a developed film resulting from the X-ray exposure of the device of FIG. 9 and 10.

Next, the exposed film is processed in the usual manner yielding an image as shown in FIG. 11 composed of a grey circle 260 the diameter of the cylinder 254 with a clear center 262. The density of the image 260 is evaluated by means of a densitometer or by visually comparing its density with the densities of the dots on the master film of FIG. 8. The dots of varying densities on the master film of FIG. 8 were experimentally produced to match the specific errors in machine calibration, and each dot designated by a number representing a correction factor, the value of the number depending upon the density of the dot. The master film is placed on a view box, and the image produced by exposing the cylinder 254 is placed on top of the master film. One at a time, the grey dots on the master film are moved inside the unexposed inner circle 262 of the image. The dot of the master film that most closely matches the density of the grey circle is carefully determined. The correction factor for the machine will be given by the matching dot (FIG. 8).

Each time the computer is used with that particular X-ray machine, the newly determined machine correction factor is added to the other correction factors needed, and placed in the opening or window 224. Once the machine correction factor has been entered, the computer can be used to compute techniques for any part of a patient.

Assuming in the example of the gallbladder radiograph given above that the machine calibration is zero and further assuming the thickness of the adult part is 18-centimeters, the $-\frac{1}{2}$ correction factor is entered in the opening 224 and the 18-centimeters is entered in opening 220. Turning the computer over so as to view the exposure chart 216, 218, suitable exposure settings for the X-ray machine may be selected. Typical of such settings would be 70-kilovolts, 4/5 second at 100-milliamperes; 80-kilovolts, 1 second at 50-milliamperes, or 90-kilovolts at 3/20th of a second at 200-milliamperes. A huge variety of other combinations of voltage, current and time are also available.

As explained earlier, each of the scales 226, 228, etc. on the surface 212 is positionally related to the graduations on the other surface 216 thereof. This relationship is shown in FIGS. 4*a*, 4*b* and 5 in which all of the scales are shown in related position, i.e., the scales on surface 212 are precisely located with respect to the scale on the surface 216 and the scale on one surface of member 210 is precisely related to the scale on the opposite surface 218 thereof.

In the following list is given the transverse positional relationship between the dimensional indicia on scale 226 and the MAS scale on surface 216.

| MAS | CM (Scale 226) |
|---|---|
| 7 | 5 |
| 9 | 6 |
| 10 | 7 |
| 12.5 | 9 |
| 15 | 10 |
| 17.5 | 11 |
| 25 | 12 |
| 30 | 13 |
| 35 | 14 |
| 40 | 15 |
| 50 | 16 |
| 60 | 17 |
| 75 | 18 |
| 80 | 19 |
| 80 | 20 |
| 100 | 22 |
| 120 | 24 |
| 150 | 26 |
| 170 | 28 |
| 200 | 30 |

The computer of this invention is a universal technique device, it is easy to use, and increases radiographic quality and consistency. Reduced repeats results in reduced cost, efficiency and reduction in exposure to patients.

While there have been described above the principles of this invention in connection with specific apparatus, it is to be clearly understood that this description is made only by way of example and not as a limitation to the scope of the invention.

What is claimed is:

1. A manually operable computer for determining a set of exposure settings of an X-ray machine, comprising:

a base member, a first scale member, a second scale member and means for supporting said members for movement relative to each other;

said base member having thereon (a) a body chart including identifying indicia for at least one body part of a subject to be X-rayed, said indicia including indexing means, and (b) a correction factor index in predetermined fixed relation to said indexing means;

said first scale member having thereon (a) a thickness chart including at least one thickness scale having values representing a plurality of thicknesses of said one body part, each of said values being registrable with said indexing means and (b) a current and time chart in predetermined fixed relation to said thickness chart including at least one current and time scale having values representing current and time exposure settings; and said second scale member having thereon, (a) a voltage scale in parallel relation with said current and time scale having values representing voltage exposure settings, each of said current and time scale values and said voltage scale values being disposed on said first and second members, respectively, such that for any setting of said first and second members said current and time values and said voltage values will be in juxtaposed relation to form sets of exposure settings, and (b) a correction factor scale in predetermined fixed relation to said voltage scale having values indicative of X-ray exposure correction factors whereby upon registration of the body part indexing means with the thickness value of the body part to be X-rayed and upon registration of the correction factor index with the appropriate correction factor value, the first and second members will be set relative to the base member thereby setting the voltage scale relative to the current and time scale whereupon the sets of exposure settings will be formed each of which will produce substantially constant density radiographs of the body part X-rayed.

2. The computer of claim 1 in which said thickness scale values and the positions thereof are arranged with respect to said sets of exposure settings according to a predetermined non-linear relationship as to provide sets of X-ray exposure settings for different thicknesses of a given anatomical subject which will yield a substantially constant density radiograph.

3. The computer of claim 2 in which said scale members are elongated with the aforesaid movement thereof being longitudinal and said thickness, voltage, current and time charts extending longitudinally thereof.

4. The computer of claim 3 in which a current and time scale includes a plurality of different time settings for a single value of current.

5. The computer of claim 3 in which the values on said voltage scale are progressive in one direction, the values of time are progressive in the opposite direction and the values of thickness are also generally progressive in said opposite direction.

6. The computer of claim 5 in which said scale members are in edge-to-edge relation and have opposite commonly facing sides, said thickness scale and said current and time scale being on opposite sides of said first scale member, said voltage scale being on the side of said second scale member facing the same as said current and time scale, said correction factor scale on said second scale member being on the side facing the same as said thickness scale, said correction factor scale including a plurality of longitudinally spaced indicia indicative of X-ray exposure correction factors, said indexing means being identifiable with selected ones of said thickness scale values and said correction factor index with said correction factor values for determining the relative positions of said first and second members.

7. The computer of claim 6 in which said first scale member has a plurality of parallel extending thickness scales, each said thickness scale representing a different anatomical part and having the thickness values thereof spaced differently than the others.

8. The computer of claim 7 in which said indexing means includes an elongated first window extending transversely of a plurality of said thickness scales and a second window in registry with said correction factor scale, said base member otherwise being generally opaque and carrying a plurality of legends in overlying registry with said plurality of thickness scales, respectively, for indicating the particular anatomical part pertaining thereto.

9. The computer of claim 8 including a third elongated window carried by said base member in parallel predetermined spaced relation with respect to said first window, said first window pertaining to adults to age 12 and over and said third window to children under age 12.

* * * * *